US007807252B2

(12) United States Patent
Hendron et al.

(10) Patent No.: US 7,807,252 B2
(45) Date of Patent: Oct. 5, 2010

(54) CHEMICAL MECHANICAL POLISHING PAD HAVING SECONDARY POLISHING MEDIUM CAPACITY CONTROL GROOVES

(75) Inventors: Jeffrey J. Hendron, Elkton, MD (US); Gregory P. Muldowney, Earleville, MD (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 694 days.

(21) Appl. No.: 11/437,050

(22) Filed: May 19, 2006

(65) Prior Publication Data

US 2006/0286350 A1 Dec. 21, 2006

Related U.S. Application Data

(60) Provisional application No. 60/691,321, filed on Jun. 16, 2005.

(51) Int. Cl.
*B24B 3/30* (2006.01)
*B24B 1/00* (2006.01)

(52) U.S. Cl. ..... 428/167; 438/692; 451/41; 451/527; 451/287

(58) Field of Classification Search ..... None
See application file for complete search history.

(56) References Cited

U.S. PATENT DOCUMENTS

| | | | | |
|---|---|---|---|---|
| 5,725,420 | A | 3/1998 | Torii | |
| 6,331,137 | B1 * | 12/2001 | Raeder et al. | 451/285 |
| 6,951,506 | B2 * | 10/2005 | Andideh et al. | 451/41 |
| 2002/0004357 | A1 * | 1/2002 | Baker et al. | 451/41 |
| 2004/0259479 | A1 | 12/2004 | Sevilla | |

* cited by examiner

*Primary Examiner*—Callie E Shosho
*Assistant Examiner*—Frank D Ducheneaux
(74) *Attorney, Agent, or Firm*—Blake T. Biederman

(57) ABSTRACT

A chemical mechanical polishing pad (104, 400) that includes a polishing layer (108, 420, 500) having a set of primary grooves (124, 408, 516) formed in a polishing surface (110, 428, 520) of the pad. The pad also includes a set of secondary grooves (128, 404, 504) that become selectively active as a function of the wear of the polishing layer from polishing.

3 Claims, 4 Drawing Sheets

CHEMICAL MECHANICAL POLISHING PAD HAVING SECONDARY POLISHING MEDIUM CAPACITY CONTROL GROOVES

CROSS REFERENCE TO RELATED APPLICATION

This application claims the benefit of U.S. Application Ser. No. 60/691,321 filed Jun. 16, 2005.

BACKGROUND OF THE INVENTION

The present invention generally relates to the field of polishing. In particular, the present invention is directed to a chemical mechanical polishing pad having secondary polishing medium capacity control grooves.

In the fabrication of integrated circuits and other electronic devices, multiple layers of conducting, semiconducting and dielectric materials are deposited onto and etched from a semiconductor wafer. Thin layers of these materials may be deposited by a number of deposition techniques. Common deposition techniques in modern wafer processing include physical vapor deposition (PVD) (also known as sputtering), chemical vapor deposition (CVD), plasma-enhanced chemical vapor deposition (PECVD) and electrochemical plating. Common etching techniques include wet and dry isotropic and anisotropic etching, among others.

As layers of materials are sequentially deposited and etched, the surface of the wafer becomes non-planar. Because subsequent semiconductor processing (e.g., photolithography) requires the wafer to have a flat surface, the wafer needs to be periodically planarized. Planarization is useful for removing undesired surface topography as well as surface defects, such as rough surfaces, agglomerated materials, crystal lattice damage, scratches and contaminated layers or materials.

Chemical mechanical planarization, or chemical mechanical polishing (CMP), is a common technique used to planarize semiconductor wafers and other workpieces. In conventional CMP using a dual-axis rotary polisher, a wafer carrier, or polishing head, is mounted on a carrier assembly. The polishing head holds the wafer and positions it in contact with a polishing layer of a polishing pad within the polisher. The polishing pad has a diameter greater than twice the diameter of the wafer being planarized. During polishing, the polishing pad and wafer are rotated about their respective concentric centers while the wafer is engaged with the polishing layer. The rotational axis of the wafer is offset relative to the rotational axis of the polishing pad by a distance greater than the radius of the wafer such that the rotation of the pad sweeps out an annular "wafer track" on the polishing layer of the pad. When the only movement of the wafer is rotational, the width of the wafer track is equal to the diameter of the wafer. However, in some dual-axis polishers the wafer is oscillated in a plane perpendicular to its axis of rotation. In this case, the width of the wafer track is wider than the diameter of the wafer by an amount that accounts for the displacement due to the oscillation. The carrier assembly provides a controllable pressure between the wafer and polishing pad. During polishing, a slurry, or other polishing medium, is flowed onto the polishing pad and into the gap between the wafer and polishing layer. The wafer surface is polished and made planar by chemical and mechanical action of the polishing layer and polishing medium on the surface.

The interaction among polishing layers, polishing media and wafer surfaces during CMP is being increasingly studied in an effort to optimize polishing pad designs. Most of the polishing pad developments over the years have been empirical in nature. Much of the design of polishing surfaces, or layers, has focused on providing these layers with various patterns of voids and arrangements of grooves that are claimed to enhance slurry utilization and polishing uniformity. Over the years, quite a few different groove and void patterns and arrangements have been implemented. Prior art groove patterns include radial, concentric circular, Cartesian grid and spiral, among others. Prior art groove configurations include configurations wherein the width and depth of all the grooves are uniform among all grooves and configurations wherein the width or depth of the grooves varies from one groove to another.

It is noted that some pad designers have designed polishing pads that include grooves not only in the polishing surface of the pad, but also in a surface opposite the polishing pad. Such pads are described, e.g., in U.S. Patent Application Publication No. US 2004/0259479 to Sevilla. The Sevilla application discloses polishing pads for a process known as electrochemical mechanical polishing (ECMP), which is similar to CMP but also includes removing conductive material from a surface of a substrate being polished by applying an electrical bias between the polished surface and a cathode. Generally, the first set of grooves in the polishing surface of the pad are provided for the CMP portion of ECMP and the second set of grooves in the surface opposite the polishing surface facilitate the flow of an electrolyte present in the polishing medium throughout the pad. The first and second sets of grooves are oriented so that they cross each other and the individual grooves are configured so that they fluidly connect with each other where they cross. While the second set of grooves provides the pad with additional grooves, all of the grooves are active from the very first use of the pad. Consequently, as the pad wears, the overall volumetric capacity of the first and second sets of grooves decreases.

Although pad designers have devised various groove arrangements and configurations, as a conventional CMP pad wears during use, the volumetric capacity of the grooves on the pad continuously decreases. This decrease in groove capacity affects the fluid dynamics of the polishing medium in the grooves and on the polishing surface of the pad. At some point during normal wear, the effect of the decreased groove capacity on the dynamics of the polishing medium can become so great that polishing is negatively impacted. When the impact of wear on polishing becomes unacceptable, the worn pad must be discarded. Consequently, there is a need for CMP pad designs that include features that can extend the useful life of a CMP pad.

STATEMENT OF THE INVENTION

In one aspect of the invention, a polishing pad, comprising: a) a polishing layer configured for polishing at least one of a magnetic, optical and semiconductor substrate in the presence of a polishing medium, the polishing layer including a polishing surface and having a thickness extending perpendicular to the polishing surface; b) a plurality of primary polishing grooves located in the polishing surface and extending into the polishing layer a distance less than the thickness; and c) a plurality of secondary polishing grooves located in the polishing layer, wherein the plurality of secondary grooves have a plurality of activation depths as measured from the polishing surface. All grooves in the plurality of secondary grooves do not cross any groove of the plurality of primary grooves In another aspect of the invention, a polishing pad, comprising: a) a polishing layer configured for polishing at least one of a magnetic, optical and semiconductor substrate in the presence of a polishing medium, the polishing layer including a first side, a second side spaced from the first side, and a thickness extending between the first side and the second side; b) a plurality of primary polishing grooves formed in the first side and extending into the polishing layer a distance less than the thickness; and c) a plurality of secondary polishing grooves formed in the second side and extending into the polishing layer a distance less than the thickness; wherein the plurality of secondary polishing grooves are configured to be activated as a function of wear of the polishing layer on the first side.

In a further aspect of the invention, a polishing pad, comprising: a) a polishing layer configured for polishing at least one of a magnetic, optical and semiconductor substrate in the presence of a polishing medium, the polishing layer having a first surface and a second surface spaced from the first surface by a thickness; b) a first plurality of grooves, formed in the first surface, each having a depth that is less than the thickness of the polishing layer; and c) a second plurality of grooves, formed in the second surface, each having a predetermined activation depth from the first surface that is less than the thickness of the polishing layer; wherein the predetermined activation depths of some of the second plurality of grooves are not equal to the predetermined activation depths of others of the second plurality of grooves.

DETAILED DESCRIPTION OF THE INVENTION

Figure 1:
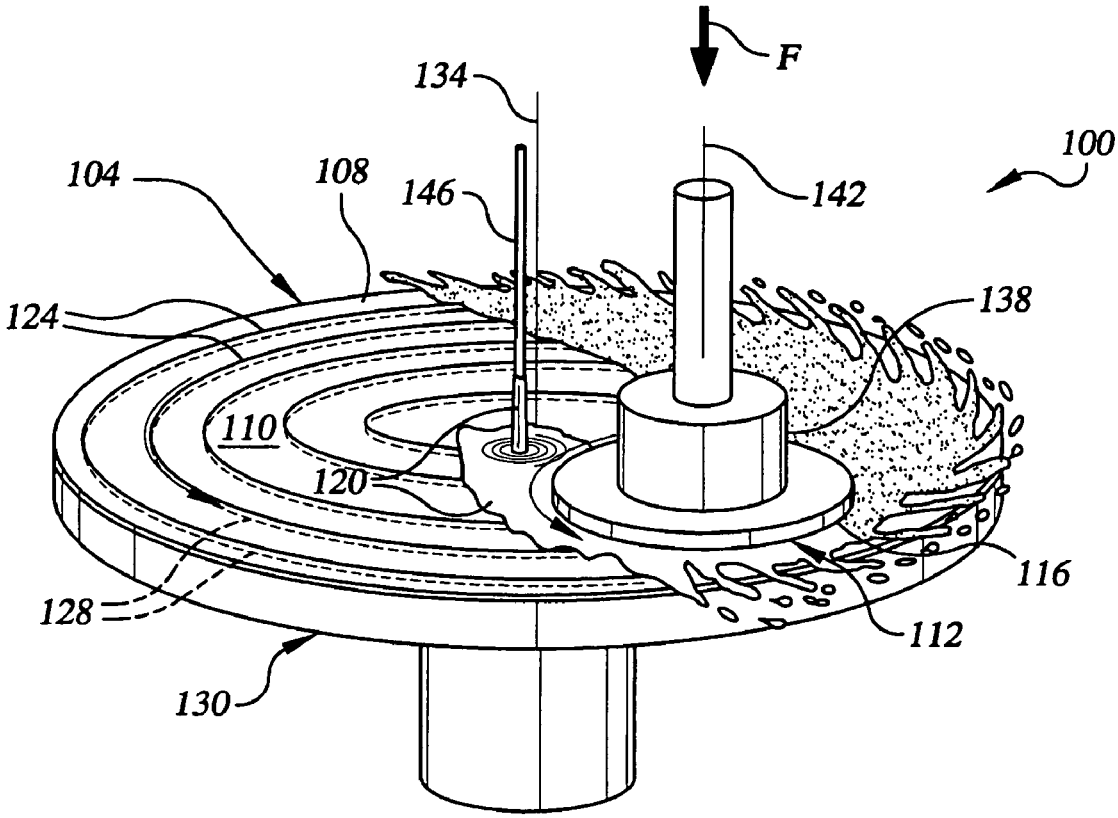
FIG. 1 is a perspective view of a portion of a dual-axis polisher suitable for use with the present invention.

Referring to the drawings, FIG. 1 generally illustrates the primary features of a dual-axis chemical mechanical polishing (CMP) polisher 100 suitable for use with a polishing pad 104 of the present invention. Polishing pad 104 generally includes a polishing layer 108 having a polishing surface 110 for confronting an article, such as semiconductor wafer 112 (processed or unprocessed) or other workpiece, e.g., glass, flat panel display or magnetic information storage disk, among others, so as to effect polishing of the polished surface 116 of the workpiece in the presence of a polishing medium 120. For the sake of convenience, the term "wafer" is used below without the loss of generality. In addition, as used in this specification, including the claims, the term "polishing medium" includes particle-containing polishing solutions and non-particle-containing solutions, such as abrasive-free and reactive-liquid polishing solutions.

The present invention generally includes providing polishing layer 108 with a set of primary grooves 124 and a set of secondary grooves 128. Primary grooves 124 are formed in polishing surface 110 and are exposed to the polishing side of polishing pad 104 and secondary grooves 128 are initially fluidly isolated from the polishing side of the pad until a certain amount of wear has occurred to polishing layer 108. Secondary grooves 128 are configured so that as polishing pad 104 wears during polishing, ones of the secondary grooves become selectively activated so that the volumetric capacity of primary grooves 124 lost as a result of wear is at least partially made up by the volumetric capacity of the activated ones of secondary grooves 128. Secondary grooves 128 may be activated by providing them at predetermined activation depths relative to the unworn location of polishing surface 110 of polishing layer 108. Then, when polishing layer 108 wears to the corresponding activation depth for a particular secondary groove 128, that groove becomes active, i.e., the groove becomes exposed on polishing surface 110 and polishing medium 120 flows in the groove. Secondary grooves 128 and their selective activation are described below in much greater detail.

Polisher 100 may include a platen 130 on which polishing pad 104 is mounted. Platen 130 is rotatable about a rotational axis 134 by a platen driver (not shown). Wafer 112 may be supported by a wafer carrier 138 that is rotatable about a rotational axis 142 parallel to, and spaced from, rotational axis 134 of platen 130. Wafer carrier 138 may feature a gimbaled linkage (not shown) that allows wafer 112 to assume an aspect very slightly non-parallel to polishing layer 108, in which case rotational axes 134, 142 may be very slightly askew. Wafer 112 includes polished surface 116 that faces polishing layer 108 and is planarized during polishing. Wafer carrier 138 may be supported by a carrier support assembly (not shown) adapted to rotate wafer 112 and provide a downward force F to press polished surface 116 against polishing layer 108 so that a desired pressure exists between the polished surface and the polishing layer during polishing. Polisher 100 may also include a polishing medium inlet 146 for supplying polishing medium 120 to polishing layer 108.

As those skilled in the art will appreciate, polisher 100 may include other components (not shown) such as a system controller, polishing medium storage and dispensing system, heating system, rinsing system and various controls for controlling various aspects of the polishing process, such as follows: (1) speed controllers and selectors for one or both of the rotational rates of wafer 112 and polishing pad 104; (2) controllers and selectors for varying the rate and location of delivery of polishing medium 120 to the pad; (3) controllers and selectors for controlling the magnitude of force F applied between the wafer and polishing pad, and (4) controllers, actuators and selectors for controlling the location of rotational axis 142 of the wafer relative to rotational axis 134 of the pad, among others. Those skilled in the art will understand how these components are constructed and implemented such that a detailed explanation of them is not necessary for those skilled in the art to understand and practice the present invention.

During polishing, polishing pad 104 and wafer 112 are rotated about their respective rotational axes 134, 142 and polishing medium 120 is dispensed from polishing medium inlet 146 onto the rotating polishing pad. Polishing medium 120 spreads out over polishing layer 108, including the gap beneath wafer 112 and polishing pad 104. Polishing pad 104 and wafer 112 are typically, but not necessarily, rotated at selected speeds of 0.1 rpm to 150 rpm. Force F is typically, but not necessarily, of a magnitude selected to induce a desired pressure of 0.1 psi to 15 psi (6.9 to 103 kPa) between wafer 112 and polishing pad 104.

Figure 2A:
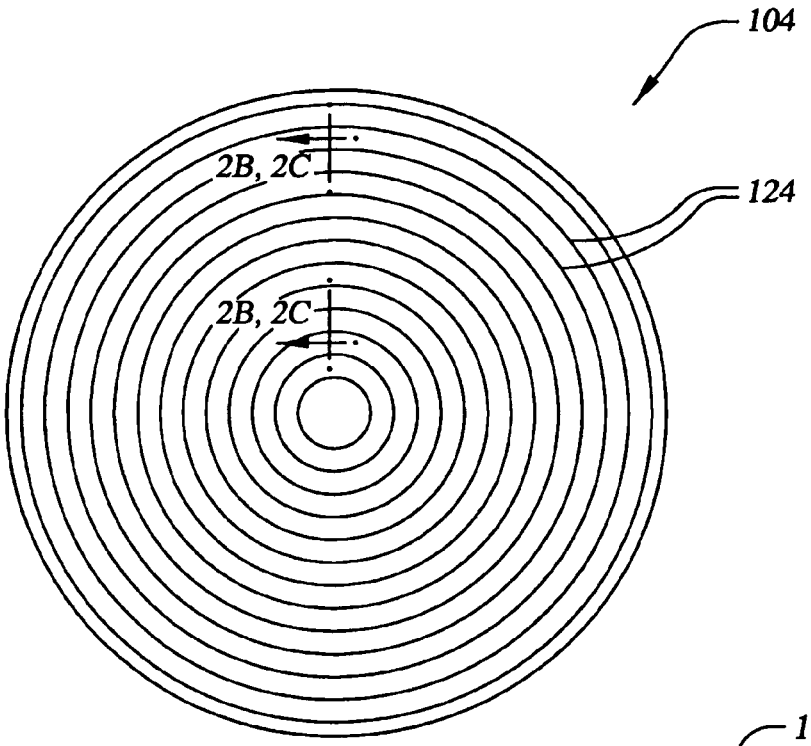
FIG. 2A is a plan view of a CMP pad of the present invention.
Figure 2B:
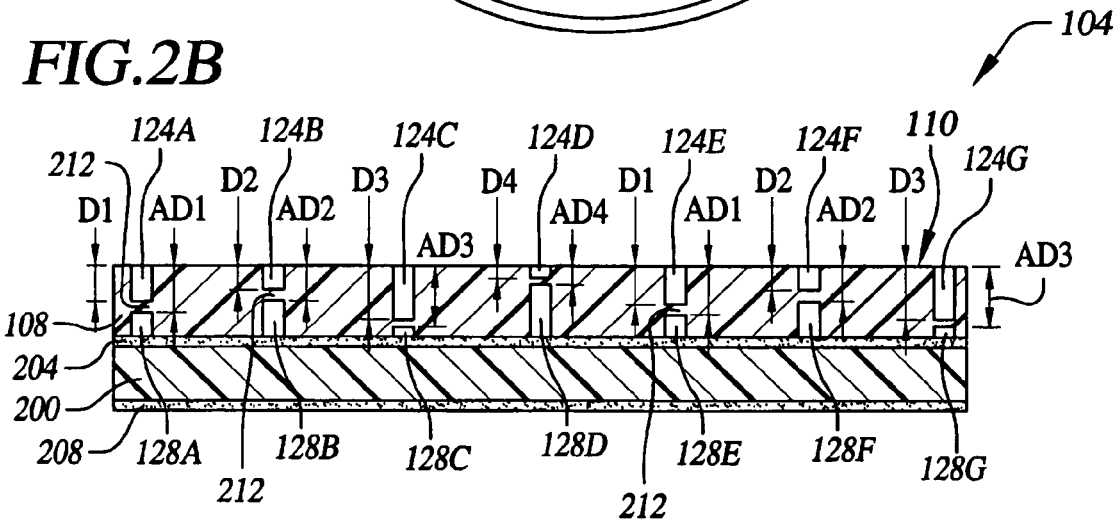
FIG. 2B is an enlarged cross-sectional view of the CMP pad as taken along line 2B-2B of FIG. 2A prior to being used for polishing.
Figure 2C:
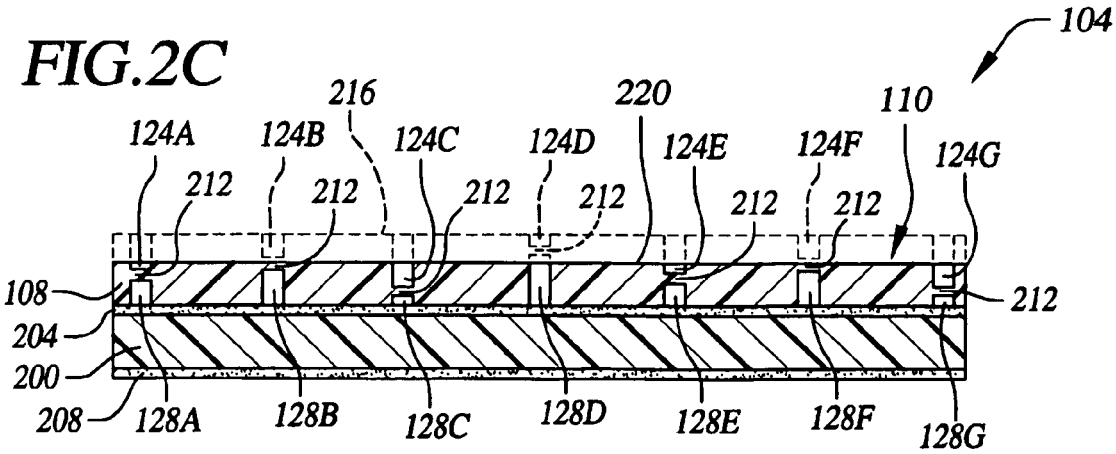
FIG. 2C is an enlarged cross-sectional view of the CMP pad as taken along line 2C-2C of FIG. 2A after a portion of the polishing layer has been worn away as a result of polishing.

Referring now to FIGS. 2A-2C, polishing pad 104 of FIG. 1 will be described in more detail, especially relative to primary grooves 124 and secondary grooves 128. As shown in FIGS. 2B and 2C, polishing pad 104 may include polishing layer 108 and a subpad 200. It is noted that subpad 200 is not required and polishing layer 108 may be secured directly to a platen of a polisher, e.g., platen 130 of FIG. 1. Polishing layer 108 may be secured to subpad 200 in any suitable manner, such as adhesive bonding, e.g., using a pressure sensitive adhesive layer 204 or hot-melt adhesive, heat bonding, chemical bonding, ultrasonic bonding, etc.

Polishing layer 108 may be made of any suitable material, such as polycarbonates, polysulfones, nylons, polyethers, polyesters, polystyrenes, acrylic polymers, polymethyl methacrylates, polyvinylchlorides, polyvinylfluorides, polyethylenes, polypropylenes, polybutadienes, polyethylene imines, polyurethanes, polyether sulfones, polyamides, polyether imides, polyketones, epoxies, silicones, copolymers thereof (such as, polyether-polyester copolymers), and mixtures thereof. For cast and molded polishing pads, the polymeric material is preferably polyurethane; and most preferably it is a cross-linked polyurethane, such as, IC1000™ or Vision-Pad™ polishing pads manufactured by Rohm and Haas Electronic Materials CMP Technologies. These pads typically constitute polyurethanes derived from difunctional or polyfunctional isocyanates, e.g. polyetherureas, polyisocyanurates, polyurethanes, polyureas, polyurethaneureas, copolymers thereof and mixtures thereof. For polishing pads formed by coagulation, preferably, the porous polymer includes polyurethane. Most preferably, the porous polishing pads have a coagulated polyurethane matrix. The coagulated matrix most preferably arises from coagulating a polyetherurethane polymer with polyvinyl chloride. Of course, as those skilled in the art will appreciate, polishing layer 108 may be made of a non-polymeric material or a composite of a polymer with one or more non-polymeric materials such as a fixed abrasive pad.

In general, the choice of material for polishing layer 108 is limited by its suitability for polishing an article made of a particular material in a desired manner. Similarly, subpad 200 may be made of any suitable material, such as the materials mentioned above for polishing layer 108. Polishing pad 104 may optionally include a fastener for securing the pad to a platen, e.g., platen 130 of FIG. 1, of a polisher. The fastener may be, e.g., an adhesive layer, such as a pressure sensitive adhesive layer 208, a mechanical fastener, such as the hook or loop portion of a hook and loop fastener.

Referring particularly to FIG. 2B, this figure shows seven primary grooves 124A-G of the thirteen total primary grooves 124 illustrated in FIG. 2A. The number of grooves 124 shown in FIG. 2A was selected for the ease of illustrating the present invention. Of course, an actual CMP pad incorporating features of the present invention will typically have more than thirteen primary grooves 124, but may also have fewer. It is noted that polishing pad 104 as show in FIG. 2B represents the pad immediately prior to being used for the first time, i.e., before polishing layer 108 has experienced any wear from polishing and polishing surface 110 is located at its greatest distance from the opposing surface of polishing layer 108.

In this particular embodiment of polishing pad 104, primary grooves 124A-G are shown as having the same widths as one another but having four different depths as measured from polishing surface 110. Primary grooves 124A and 124E each have a first depth, grooves 124B and 124F each have a second depth, grooves 124C and 124G each have a third depth and groove 124D has a fourth depth. Four depths are shown merely for illustration of the present invention. In alternative embodiments, grooves 124 (FIG. 2A) may have more or fewer than four different depths. At one extreme, the depths of all primary grooves 124 may be the same as one another. At the other extreme, the depth of each primary groove 124 may be different from the depth of each other groove.

The selection of groove depth for primary grooves 124 may be made using conventional criteria, e.g., desired fluid dynamics of a polishing medium (not shown), with further consideration given to providing polishing pad 104 with a variable volumetric groove capacity in accordance with the present invention. While primary grooves 124 are shown as being circular grooves having uniform widths, these grooves may have virtually any configuration and arrangement, e.g., shape, width, pitch, length, etc., desired to suit a particular design.

Referring again particularly to FIG. 2B, secondary grooves 128A-G are shown as being in registration with corresponding respective primary grooves 124A-G, i.e., each secondary groove is aligned with a corresponding respective primary groove along its entire length. In this case, primary and secondary grooves 124A-G, 128A-G are formed so that a portion of pad material is present between the bottom of each primary groove and the top of each secondary groove so as to form a barrier 212 that inhibits flow of a polishing medium from that primary groove to that secondary groove. As mentioned above, each primary groove 124A-G has a depth as measured from polishing surface 110, in this case one of depths $D_1$-$D_4$, and each secondary groove 128A-G has an activation depth as also measured from the polishing surface, in this case one of activation depths $AD_1$-$AD_4$. Consequently, the thickness of each barrier 212 before any wear occurs thereto is equal to the difference between the depth D of the corresponding primary groove 124A-G and the activation depth AD of the respective secondary groove 128A-G. The thickness of barriers 212 across primary and secondary grooves may be the same or may vary among the grooves in any manner desired to suit a particular design.

Referring now to FIG. 2C, and also to FIG. 2B, FIG. 2C illustrates the state of primary and secondary grooves 124A-G, 128A-G after CMP pad 104 has been used for polishing and polishing layer 110 has been worn down from the original location 216 to the worn location 220 of the polishing surface shown. In this instance, it is seen that primary grooves 124B, 124D and 124F have been completely worn away, about 80% of each of primary grooves 124A and 124E have been worn away and about 60% of primary grooves 124C and 124G have been worn away. In addition, barrier 212 between primary and secondary grooves 1241), 128D has been worn away so that secondary groove 1281) has been activated, i.e., the polishing medium can now flow into and within secondary groove 128D. Barriers 212 between pairs of primary and secondary grooves [124B, 128B] and [124F, 128F] have been worn about halfway through and the barriers between groove pairs [124A, 128A], [124C, 128C], [124E, 128E] and [124G, 128G] have not yet been worn at all. In this case, the volumetric polishing medium capacity of the grooves in the portion of pad 104 illustrated in FIG. 2C, i.e., the "effective groove capacity," is equal to the sum of the remaining volumetric capacities of primary grooves 124A, 124C, 124E and 124G and the remaining volumetric capacity of secondary groove 128D. As pad 104 wears further, others of secondary grooves 128A-C, E and F will become activated when their corresponding barriers 212 are worn through. All grooves in the second plurality of grooves do not cross any groove of the first plurality of grooves.

In selecting the volumetric capacities of individual primary grooves 124 and individual secondary grooves 128, as well as depth D of each primary groove and activation depth AD of each secondary groove, there are several considerations that a pad designer would likely want to consider. For example, one consideration is to reduce or avoid any localized conditions that may negatively impact polishing. A response to this consideration may be to vary the depths D and volumetric capacities of the primary grooves and the activation depths AD and volumetric capacities of the secondary grooves across CMP pad 104 so as to distribute the volumetric capacity in a manner that provides the least detriment to polishing (e.g., so as to avoid regions of relatively little or no volumetric capacity that would tend to cause hydroplaning of the item being polished). One way to reduce detrimental localized effects may be to randomly vary the volumetric capacities of primary and secondary grooves 124, 128 and corresponding depths D and activation depths AD.

Figure 3:
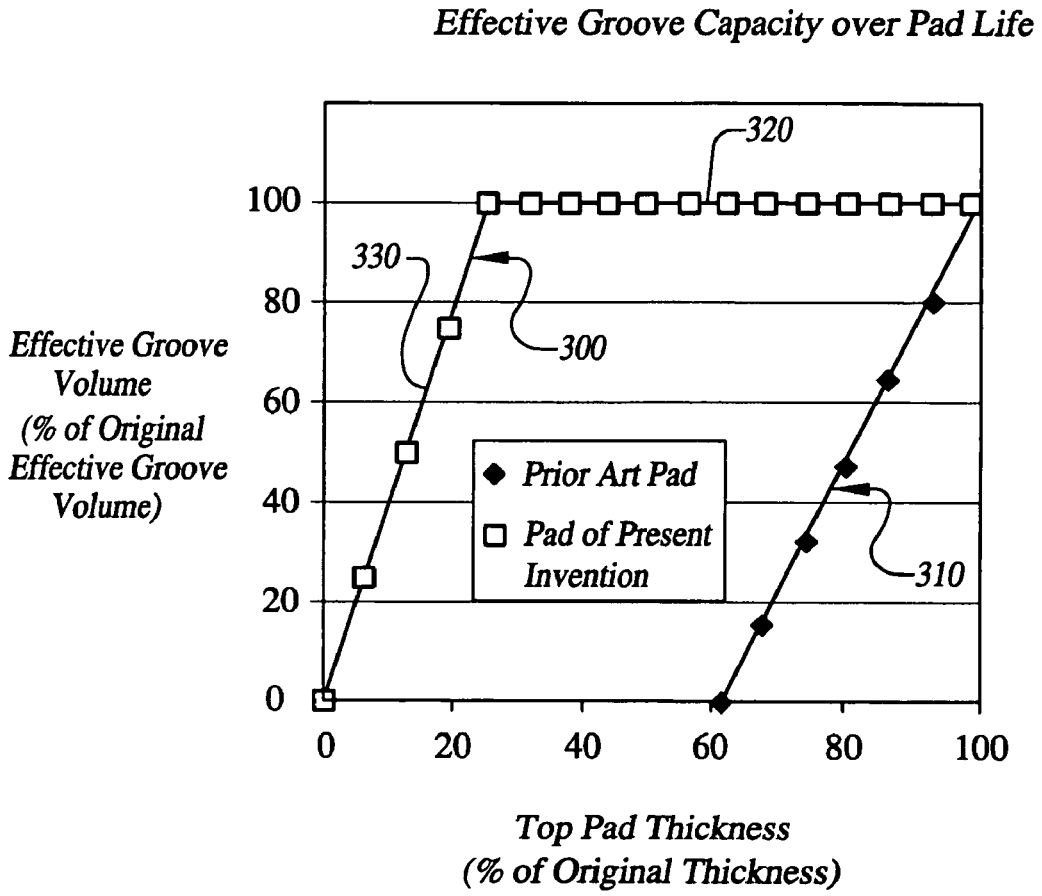
FIG. 3 is a plot of effective groove capacity over the life of a CMP pad of the present invention as compared to a prior art CMP pad.

Another consideration a pad designer may desire to consider is the effective groove capacity of CMP pad 104 over the life of the pad, i.e., over the time the pad is being worn away. FIG. 3 illustrates this concept. Referring to FIG. 3, this figure shows a plot 300 of the effective groove capacity of a CMP pad (not shown) made in accordance with the present invention over the life of the pad and a plot 310 of the effective groove capacity of a conventional CMP pad (not shown) over the life of the pad. In this example, the inventive CMP pad included primary grooves and secondary wear-activated grooves in the manner discussed above in connection with FIGS. 2A-2C. In contrast, the conventional pad contained only conventional grooves that were similar to the primary grooves of the inventive pad.

As can be seen from FIG. 3, the effective groove volume of the conventional pad decreases continuously and relatively rapidly as the pad wears. In this example, the grooves of the conventional pad had an original depth of 37% of the original thickness so that when the polishing layer wore from its original (100%) thickness to 63% of the original thickness, the effective groove volume became zero. In other words, when 37% of the polishing layer wore away, the grooves were completely gone. At this point, 63% of the original thickness of the polishing layer remained. As the polishing layer of the conventional pad wore down, at some point (say, e.g., when the effective groove volume became 40% of the original capacity), the pad generally became unsuitable for use because the reduced groove volume at this point was negatively affecting polishing more than acceptable. At an effective groove volume of 40%, the remaining thickness of the polishing layer was about 79% of the original thickness. Consequently, the pad needed to be discarded after only about 21% of the polishing layer was worn away.

The effective groove volume of the inventive pad, on the other hand, generally stayed constant from the original thickness down to a thickness of about 25% of the original thickness. In this case, 75% of the polishing layer had been worn away, but the pad substantially still retained its original effective groove volume. Using the same 40% effective groove volume at which the pad became unsatisfactory, this point was not reached in the inventive pad until the polishing layer had only about 10% of the original thickness remaining. This example clearly illustrates that the useful life of a CMP pad of the present invention can far outlast the useful life of a comparable conventional CMP pad and that a CMP pad of the present invention can make more efficient use of the material(s) that make up the polishing layer than a conventional pad. Optionally, the first plurality of grooves has an initial polishing medium capacity and, when the polishing layer is worn so that the first plurality of grooves has a reduced capacity of 50% of the initial polishing medium capacity, at least some of the second plurality of grooves are active so as to provide the polishing layer at least 25% of the initial polishing medium capacity.

As those skilled in the art will readily appreciate, the horizontally linear portion 320 of effective groove volume plot 310 of the inventive CMP pad is achieved by carefully selecting the volumetric capacities, depths and activation depths of the primary and secondary grooves so that as wear causes a decrease in the volumetric capacity of the primary grooves, the wear also causes ones of the secondary grooves to become activated to, essentially, replace the volumetric capacity of the primary grooves lost to the wear. In practice, an effective volume plot for an actual pad will generally not be perfectly linear, but rather will be at least somewhat spiky due to the entire volumetric capacity of each secondary groove becoming active as soon as the last bit of the corresponding barrier (see barriers 212 of FIG. 2B) becomes worn away. Consequently, for the relatively small amount of volumetric capacity of the already-active grooves lost as one or more barriers closely approach and become worn through, all of the volumetric capacity of the secondary groove(s) becoming active based on this wear-through will become activated at once so as to cause a spike in the plot. Once all of the barriers have been worn through and no reserve volumetric capacity remains in the secondary grooves, the volumetric capacity of the remaining grooves will generally decrease rather rapidly in a manner similar to plot 300 of the conventional pad. Portion 330 of plot 310 illustrates the decrease in effective groove volume after all of the secondary grooves have been activated.

The portion of a plot, such as plot 310, of the effective groove volume of a pad made in accordance with the present invention that begins when the first secondary groove is activated and ends when the last secondary groove is activated may be referred to as the "controllable portion" of the plot, since it is within this portion that the effective groove volume is affected by the predetermined activation of the secondary grooves. Those skilled in the art will readily appreciate that a pad designer can control the general trend of the effective groove volume plot in the controllable portion of the plot. That is, the controllable portion of the plot need not have a horizontal linear portion as illustrated at portion 320 of FIG. 3, but rather the controllable portion may have virtually any shape desired. For example, the primary and secondary grooves can be configured so that the effective groove volume of the polishing pad in the controllable portion of the corresponding plot (not shown) has a general decreasing trend as the pad wears to the point where all secondary grooves have been activated or, alternatively, a general increasing trend as the pad wears to the point where all secondary grooves have been activated. In other embodiments, e.g., the primary and secondary grooves can be configured so that the effective groove volume first increases and then decreases, or first decreases and then increases, as the pad wears to the point where all secondary grooves have been activated.

Figure 4A:
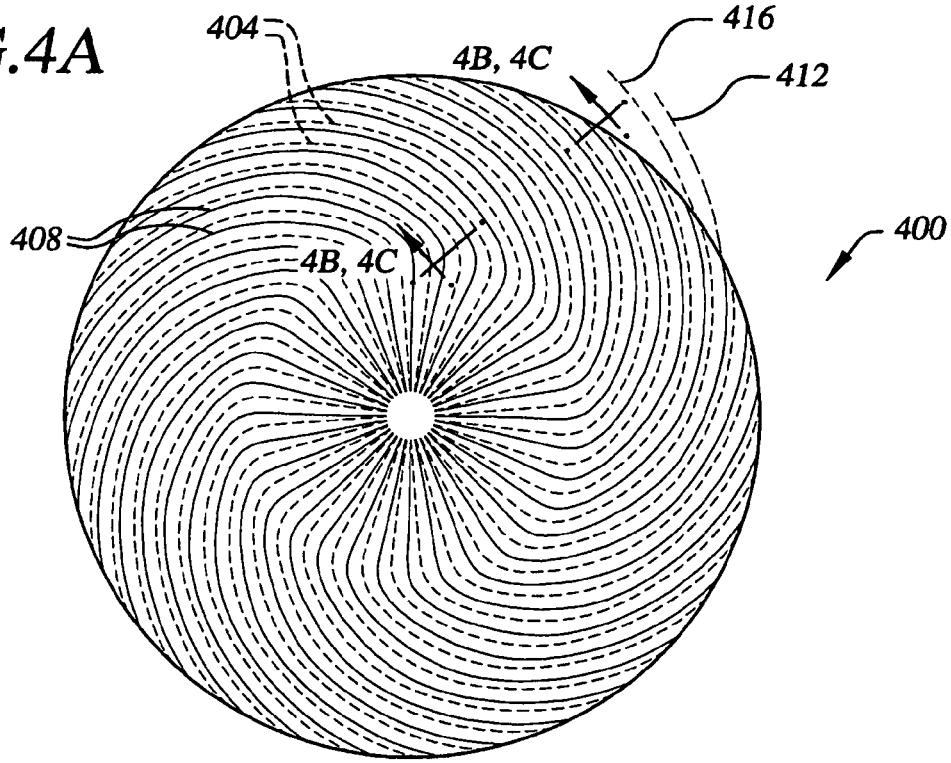
FIG. 4A is a plan view of an alternative CMP pad of the present invention.
Figure 4B:
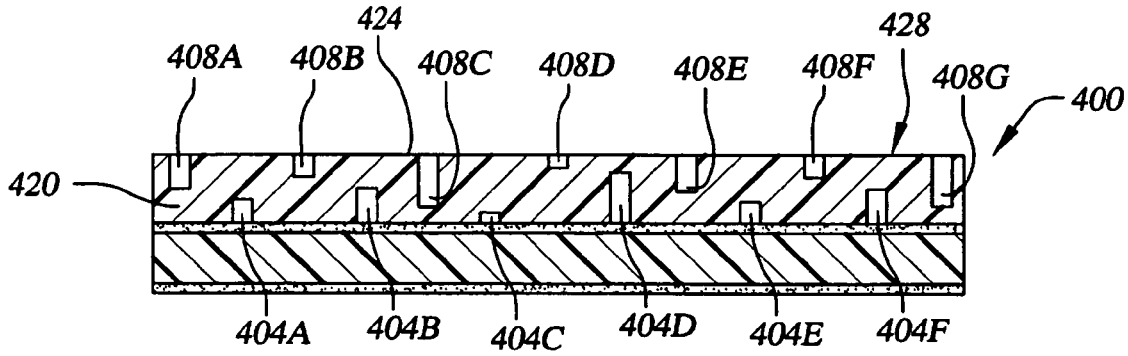
FIG. 4B is an enlarged cross-sectional view of the CMP pad as taken along line 4B-4B of FIG. 4A prior to being used for polishing.
Figure 4C:
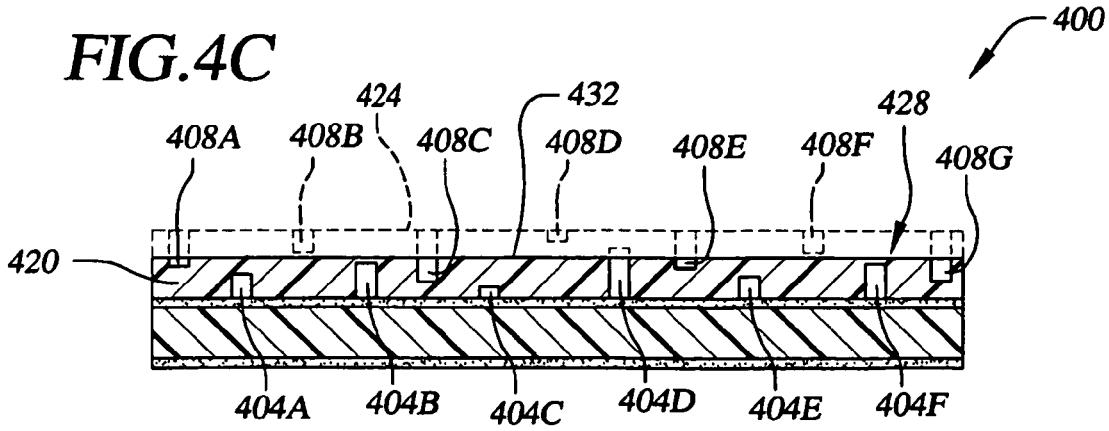
FIG. 4C is an enlarged cross-sectional view of the CMP pad as taken along line 4C-4C of FIG. 4A after a portion of the polishing layer has been worn away as a result of polishing.

FIGS. 4A-4C show another pad 400 of the present invention that may be used with a rotary-type polisher, such as polisher 100 of FIG. 1. In general, pad 400 illustrates the broad concept that the secondary grooves, in this case secondary grooves 404, need not be in registration with the primary grooves, in this case primary grooves 408. As shown in FIGS. 4A-4C, primary and secondary grooves 404, 408 may, e.g., be laterally offset from one another, i.e., the central longitudinal axis 412 of each primary groove may be spaced from the central longitudinal axis 416 of at least one corresponding immediately adjacent secondary groove. FIG. 4B shows seven primary grooves 408A-G of the thirty-two primary grooves 408 shown in FIG. 4A and six secondary grooves 404A-F of the thirty-two secondary grooves 404 shown in FIG. 4A. It is noted that the shapes, sizes and numbers of primary and secondary grooves 408, 404 shown are merely exemplary, and like primary and secondary grooves 124, 128 of FIGS. 1 and 2A-2C, the shape, size, length, width, pitch and number of primary and secondary grooves 408, 404 may be changed as desired to suit a particular design.

FIG. 4B shows CMP pad 400 before the polishing layer 420 has incurred any wear. At this stage, only primary grooves 408A-G would be active in polishing. That is, when pad 400 is unworn, only primary grooves 408A-G would receive any polishing medium (not shown) during polishing. In accordance with the present invention when pad 400 is unworn, secondary grooves 404A-F would remain isolated from the polishing medium due to the fact that they do not extend to the original location 424 of the polishing surface 428 of the unworn pad 400.

In contrast, FIG. 4C shows polishing pad 400 after about 40% of the thickness of polishing layer 420 has been worn away from original location 424 of polishing surface 428 to worn location 432 of the polishing surface. As can be readily seen from FIG. 4C, during the wearing of polishing layer 420 from original location 424 of polishing surface 428 to its worn location 432, primary grooves 408B, 408D and 408F were completely worn away, primary grooves 408A, 408C, 408E and 408G were partially worn away, secondary groove 404D was activated and partially worn away and secondary grooves 404A, 404B, 404C, 404E and 404F were not yet activated. As with primary grooves 124A-G of FIGS. 2B and 2C, primary grooves 408A-G may have any depths D1 suitable to achieve a particular design. Similarly, like secondary grooves 128A-G, secondary grooves 404A-F may have any activation depths AD1 suitable to achieve a particular design. Likewise, depths D1 and activation depths AD1, as well as individual groove capacities of primary and secondary grooves 408, 404, may be selected to achieve a desired profile of the plot of the effective groove volume versus wear as described above relative to FIG. 3.

Figure 5:
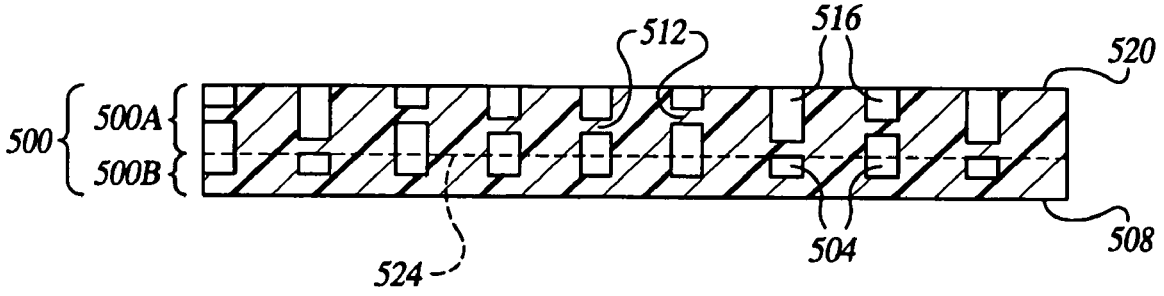
FIG. 5 is a cross-sectional view of a polishing layer having secondary grooves buried within the polishing layer.

FIG. 5 illustrates an alternative unworn polishing layer 500 that may be attached to a subpad (not shown) or, alternatively, directly to a platen (not shown) in, e.g., the same manner discussed above relative to polishing layer 108 described above in connection with FIGS. 2A-C. Polishing layer 500 of FIG. 5 differs from polishing layers 108 (FIGS. 1 and 2A-C) and 420 (FIGS. 4A-C) primarily in that the secondary grooves 504 of polishing layer 500 do not extend to the backside surface 508 of the polishing layer, whereas secondary grooves 128A-G, 404A-G extend to the backside surfaces (not labeled) of the corresponding respective polishing layers 108, 420.

It is realized that secondary grooves 504 of unworn polishing layer 500 are, in fact, not grooves since they do not extend to backside surface 508. However, their status as grooves is warranted because they will become grooves when polishing layer 500 becomes so worn that barriers 512 become worn away so that secondary grooves 504 become activated. It is noted that while secondary grooves 504 are shown as being in registration with the primary grooves 516 in polishing surface 520, this need not be the case. For example, in alternative embodiments secondary grooves 504 may be interdigitated with primary grooves 516 in a manner similar to primary and secondary grooves 408A-G, 404A-G shown in FIGS. 4A-C. Other aspects of primary and secondary grooves 516, 504, such as their configuration and arrangement, e.g., shape, width, pitch, length, depth, height, etc., may be virtually any configuration and arrangement desired to suit a particular design.

Polishing layer 500 may be fabricated in any of a number of ways. For example, polishing layer 500 may be made by joining with one another two (or more) sub-layers, e.g., sub-layers 500A-B delineated by dashed line 524. In the embodiment illustrated, all or portions of each primary and secondary groove 516, 504 may be formed in sub-layers 500A-B prior to the sub-layers being joined. In order to completely form some of primary and secondary grooves 516, 504 shown that extend into both sub-layers 500A-B, the sub-layers must be placed in proper registration prior to fixedly joining them together. The joining of sub-layers 500A-B may be performed in any suitable manner, such as by adhesive bonding, chemical bonding and heat bonding, among others.

In an alternative method of fabricating polishing layer 500, secondary grooves 504 may be formed by casting polishing layer material around a space-filler (not shown) corresponding to the secondary grooves. Once the polishing layer material has set, cured, or otherwise hardened, the space-filler may be removed, such as by applying heat, e.g., to melt or vaporize the space-filler, or by dissolving the space-filler, among other methods. Once the space-filler has been removed, polishing layer 500 will be left with voids that are secondary grooves 504.

The invention claimed is:

1. A polishing pad, comprising:

a) a polishing layer configured for polishing at least one of a magnetic, optical and semiconductor substrate in the presence of a polishing medium, the polishing layer including a polishing surface and having a thickness extending perpendicular to the polishing surface;

b) a plurality of primary polishing grooves located in the polishing surface and extending into the polishing layer a distance less than the thickness; and c) a plurality of secondary polishing grooves located in the polishing layer, wherein the plurality of secondary polishing grooves have a plurality of activation depths as measured from the polishing surface and the plurality of secondary polishing grooves is in registration with or interdigitated with grooves of the plurality of primary polishing grooves with ones of the secondary polishing grooves becoming activated for replacing volumetric capacity of ones of the primary polishing grooves lost to wear, all grooves in the plurality of secondary polishing grooves do not cross any groove of the plurality of primary polishing grooves from a plan view and wherein the plurality of primary polishing grooves has an initial polishing medium capacity for the polishing layer and, when the polishing layer is worn so that the plurality of primary polishing grooves has a reduced capacity of 50% of the initial polishing medium capacity for the polishing layer, at least some of the plurality of secondary polishing grooves are activated so as to provide the polishing layer with additional polishing medium capacity for the polishing layer; and the additional polishing medium capacity for the polishing layer being at least 25% of the initial polishing medium capacity for the polishing layer.

2. The polishing pad according to claim 1, wherein each groove of the plurality of secondary polishing grooves is in registration with a corresponding respective groove of the plurality of primary polishing grooves.

3. The polishing pad according to claim 1, wherein grooves of the plurality of secondary polishing grooves are interdigitated with grooves of the plurality of primary polishing grooves.

* * * * *